US010690384B2

(12) United States Patent
Pfütze

(10) Patent No.: US 10,690,384 B2
(45) Date of Patent: Jun. 23, 2020

(54) DEVICE AND METHOD FOR CONTROLLING THE TEMPERATURE OF A MEDIUM

(71) Applicant: Uwe Pfütze, Ahrensbök (DE)

(72) Inventor: Uwe Pfütze, Ahrensbök (DE)

( * ) Notice: Subject to any disclaimer, the term of this patent is extended or adjusted under 35 U.S.C. 154(b) by 263 days.

(21) Appl. No.: 15/741,790

(22) PCT Filed: Jul. 1, 2016

(86) PCT No.: PCT/EP2016/065561
§ 371 (c)(1),
(2) Date: Mar. 21, 2018

(87) PCT Pub. No.: WO2017/005643
PCT Pub. Date: Jan. 12, 2017

(65) Prior Publication Data

US 2018/0202695 A1 Jul. 19, 2018

(30) Foreign Application Priority Data

Jul. 8, 2015 (DE) ..... 10 2015 110 994

(51) Int. Cl.
*F25B 21/04* (2006.01)
*F25B 9/00* (2006.01)
(Continued)

(52) U.S. Cl.
CPC ..... *F25B 21/04* (2013.01); *F25B 9/004* (2013.01); *F25B 21/02* (2013.01); *F25B 25/005* (2013.01)

(58) Field of Classification Search
CPC ..... F25B 25/00; F25B 25/005; F25B 25/02; F25B 9/06; F25B 2313/027; F25B 3513/00; F25B 21/02
See application file for complete search history.

(56) References Cited

U.S. PATENT DOCUMENTS 6,148,634 A * 11/2000 Sherwood ..... C09K 5/041 62/434
6,327,866 B1 12/2001 Novak
2002/0007644 A1* 1/2002 Kelley ..... E21B 36/001 62/260

FOREIGN PATENT DOCUMENTS

DE 2508043 9/1976
EP 0690275 1/1996
(Continued)

OTHER PUBLICATIONS

JP-2004100993-A Translation (Year: 2004).*

*Primary Examiner* — Brian M King
(74) *Attorney, Agent, or Firm* — Sand, Sebolt & Wernow Co., LPA

(57) ABSTRACT

A device for controlling the temperature of a medium, comprising: a first circuit in which a first heating medium circulates without phase transitions; a second circuit in which a second gaseous heating medium circulates without phase transitions; a first heat converter arranged in the first circuit and in which the first medium exchanges heat with a surrounding medium: a second heat converter arranged in the first circuit and in which the first medium exchanges heat with the medium to be temperature-controlled; a first delivery means arranged in the first circuit for moving the first medium; a compressor arranged in the second circuit for compressing the second medium; a third heat converter arranged behind the compressor when seen in the flow direction so as to contact the second circuit and which exchanges heat with the first medium; and means for cooling or expanding the first medium.

15 Claims, 3 Drawing Sheets

(51) Int. Cl.
*F25B 25/00* (2006.01)
*F25B 21/02* (2006.01)

(56) References Cited

FOREIGN PATENT DOCUMENTS

| | | | | | |
|---|---|---|---|---|---|
| EP | 2518423 | | | 10/2012 | |
| JP | 2004100993 | A | * | 4/2004 | ..... F25B 9/004 |
| WO | 2000065287 | | | 11/2000 | |

* cited by examiner

DEVICE AND METHOD FOR CONTROLLING THE TEMPERATURE OF A MEDIUM

TECHNICAL DOMAIN

The invention relates to a device and method for controlling the temperature of a fluid.

The air conditioning of vehicles such as cars, trucks, buses, trams, passenger cars of trains and the like, as well as buildings such as residential buildings, office buildings, workshops, production halls and the like, is important for the well-being and safety of the persons staying in vehicles and rooms.

Full air conditioning according to DIN EN 13779 is defined as the air conditioning system ensuring ventilation, heating, cooling, humidification, and dehumidification. Partial air conditioning is available in the following versions: ventilation and heating with and without humidification function, with cooling function and with cooling and humidifying function.

PRIOR ART

Known means to air condition rooms or to control the temperature of fluids, which can then effect the air conditioning of rooms, are heat pumps (for heating units) and air conditioning systems (for cooling).

However, such elements can also be used as units for controlling the temperature of machines and installations for heating or for cooling a working fluid, e.g. a liquid used to operate cooling or temperature control devices, e.g. in connection with electronic household appliances.

Typical features of such heat pumps and air conditioners in accordance with the prior art are listed below:

- There is a heat transfer fluid circuit in which a heat transfer fluid routed in the heat transfer fluid circuit is vaporized and liquefied.
- There is an evaporator (usually plate heat exchanger) in which the heat transfer fluid is subjected to a phase transition (vaporized).
- There is a compressor for compressing the heat transfer fluid (predominantly scroll compressors).
- There is a condenser (usually a plate heat exchanger) for liquefying the heat transfer fluid previously in the evaporator subjected to the phase transition.
- There is an expansion valve for expanding the heat transfer fluid.
- Generally, a climate-wrecking heat transfer fluid is used (usually R134a, R407c, and R410a). These heat transfer fluids have a very high global warming potential (GWP) [according to the Bundesfachschule Kä lte-Klima (Federal Technical-Vocational-Educational Training Center Cooling and Refrigeration): for R134a: 1,430, corresponding to 19.86 years, for R407c: 1,770, corresponding to 24.58 years, for R410c: 2,090. corresponding to 29.03 years].

A standard heat pump today is subject to considerable pressure of up to and more than 20 bar. This increases the risk of leaks and accidents. In addition, correspondingly safe materials and higher material thicknesses have to be used.

Because of the use of the heat transfer fluids listed above and other conventional heat transfer fluids used today, not every material, which is basically suitable for the temperatures, can be used in the design of such devices.

The evaporator used in today's systems is typically a special design of a heat exchanger, as the aggregate state is changed from liquid to gaseous inside the heat exchanger.

Scroll compressors run quietly, are highly efficient due to low mechanical losses, and have a minimal compression clearance volume. However, disadvantages of scroll compressors are the low compression end temperature, which has to be minimized for a possibly excessively high temperature using an injection of 10% to 15% of the heat transfer fluid. Another major disadvantage is the very limited power control (with the exception of some Japanese models). Scroll compressors have few pressure oscillations (pressure pulsation).

This type of compressor (scroll compressor) requires lubricating using oil. Polyvinyl ether oil (PVE) or polyolester oil (POE) are used for this purpose. POE reacts chemically with water to form an acid, resulting in corresponding requirements in the selection of the material, which must be acid-resistant. For that reason, the compressor is not as durable and more susceptible to failure.

Another disadvantage of scroll compressors is the high oil carry-over, as a high oil carry-over results in a large amount of oil in the compressor circuit. An oil pan is required to protect the environment, for outdoor installation or possibly cold locations an electrical band heater is required, resulting in a further consumption of energy for operating the system.

The condenser is also typically a special type of heat exchanger, as in it a change of the state of aggregation occurs as well, in this case from gaseous to liquid.

When used as a heat pump for heating, the transport of ambient heat from the evaporator to the compressor occurs at a low temperature level in the gaseous state. The heat transfer from the compressor to the condenser at a high energy level is also gaseous. The heat transfer from the condenser to the expansion valve occurs at a fluid temperature level in the liquid state of aggregation. The heat transfer fluid is liquid from the expansion valve to the evaporator, at a very low energy level.

When used as an air conditioning system for cooling vehicles, the compression of the heat transfer fluid occurs in a compressor, which is connected directly to the vehicle engine via a compressor clutch. The heat transfer fluid after compression is highly pressurized and gaseous. Then the gaseous heat transfer fluid flows to the condenser and there is cooled down by means of the head wind and by the condenser fan. Now the heat transfer fluid is highly pressurized, but liquid. Then, the heat transfer fluid flows into a filter drier and remains highly pressurized and liquid, up to the expansion valve downstream. In the expansion valve, the heat transfer fluid is expanded and cooled down. The pressure is decreased and the heat transfer fluid is still liquid. Now the liquid and cool heat transfer fluid flows through the evaporator. A fan is used to aspirate air through the evaporator and blow it into the passenger compartment as cool air. Due to the aspirated warm fresh air, the heat transfer fluid in the evaporator is heated and at low pressure becomes gaseous again. Now the gaseous heat transfer fluid flows at low pressure through the expansion valve and back to the compressor. There it is compressed again and the cycle starts anew.

An important decision criterion for heat pumps and air conditioning systems is the so-called COP value (coefficient of performance, for heat pumps), or the so-called EER value (energy efficiency ratio, for air conditioning systems). This value is calculated from the amount of heat generated divided by the electrical energy consumed (for compressor, controller, regulation and internal pumps of the heat pump or the air conditioning system) in full load operation. A typical size of the COP or EER is between 3 and 6;

Another important assessment criterion for heat pumps is the so-called JAZ (Jahresarbeitszahl—annual coefficient of performance.). This is computed from the actually delivered amount of heat divided by the actually supplied electrical energy (including that supplied outside the heat pump, needed for heating). Typical sizes for the JAZ are between 2.5 and 4.

Another criterion, the so-called ESEER value (European Seasonal Energy Efficiency Ratio) takes into account the turndown of the air conditioner or heat pump, because an inverter air conditioner or a heat pump operate almost exclusively in turndown mode.

Presentation of the Invention

The present invention sets out to provide a device and a method for controlling the temperature of a fluid, which eliminates the abovementioned disadvantages and in particular shows high energy efficiency. In doing so, it is also desired, at least in an advantageous embodiment, to provide a device for controlling the temperature of a fluid, which is designed and set up to operate both as a heating device and for air conditioning purposes. If possible, the invention shall be used to avoid the large size and high weight of known devices.

This problem is solved by a device having the features of a first closed heat transfer fluid circuit, in which a first heat transfer fluid circulates, the first heat transfer fluid being selected to circulate without phase transitions in the first heat transfer fluid circuit; a second closed heat transfer fluid circuit, in which a second, gaseous heat transfer fluid circulates, wherein the second, gaseous heat transfer fluid is selected such that it flows through the second heat transfer fluid circuit without phase transitions; a first heat exchanger, arranged in the first heat transfer fluid circuit, in which first heat exchanger the first heat transfer fluid can be brought into heat exchange with an ambient medium; a second heat exchanger, arranged in the first heat transfer fluid circuit, in which second heat exchanger the first heat transfer fluid can be brought into heat exchange with the fluid, whose temperature is to be controlled; a first conveying means arranged in the first heat transfer fluid circuit for moving the first heating fluid in the first heat transfer fluid circuit; a compressor arranged in the second closed heating circuit for compressing the second, gaseous heat transfer fluid; a third heat exchanger, which is disposed downstream of the compressor and in contact with the second heat transfer fluid circuit as seen in the flow direction of the second heat transfer fluid and which exchanges heat with the first heat transfer fluid in the first heat transfer fluid circuit; and a means) for cooling down and/or expanding the first heat transfer fluid in the first heat transfer fluid circuit. Advantageous embodiments of such a device include that a liquid is used as the first heat transfer fluid, which liquid is liquid at atmospheric pressure in any case in the temperature range from −50° C. to +60° C. The first heat transfer fluid is a hydrofluoroether. At least one Peltier element may be used as a means for cooling down the first heat transfer fluid. A fourth heat exchanger is provided in the device, which heat exchanger is integrated in the second heat transfer fluid circuit and is arranged upstream of the compressor and which is in a heat exchange connection with the first heat transfer fluid routed in the first heat transfer fluid circuit. The fourth heat exchanger comprises three separate pipeline strands, mutually heat exchanging, of which a first pipeline strand belongs to the second heat transfer fluid circuit, a second pipeline strand belongs to a first section of the first heat transfer fluid circuit and a third pipeline strand belongs to a second section of the first heat transfer fluid circuit. The second section of the first heat transfer fluid circuit to which the third pipeline strand belongs, can be incorporated into the first heat transfer fluid circuit or separated therefrom and can be bypassed using pertinent valves. A controllable, expansion valve is arranged in the second section. The first conveying means is reversible with respect to the conveying direction. The compressor is a turbocompressor. A method according to the invention includes that a first heat transfer fluid is routed in a first closed heat transfer fluid circuit and is circulated therein by a first conveying means to absorb and give off heat, wherein the first heat transfer fluid in the first heat transfer fluid circuit is routed through a first heat exchanger to exchange heat with an ambient medium and wherein the first heat transfer fluid is routed through a second heat exchanger to exchange heat with the fluid whose temperature is to be controlled, characterized in that the first heat transfer fluid is routed in the first heat transfer fluid circuit without undergoing phase transitions in the first heat transfer fluid circuit, in that, for heating the fluid whose temperature is to be controlled, the first heat transfer fluid is routed by the conveying means through the first heat exchanger in order to absorb heat there, in that the first heat transfer fluid is routed through a third heat exchanger after having flowed through the first heat exchanger, which is integrated in a second closed heat transfer fluid circuit, in which a second, gaseous heat transfer fluid is circulated without phase transitions, wherein a compressor is disposed upstream of the third heat exchanger in the second heat transfer fluid circuit, as seen in the direction of flow of the second heat transfer fluid, which compressor compresses and heats the second heat transfer fluid, wherein the first heat transfer fluid absorbs heat from the second heat transfer fluid in the third heat exchanger, in that the first heat transfer fluid is routed through the second heat exchanger after passing through the third heat exchanger, in which second heat exchanger the first heat transfer fluid gives off heat to the fluid whose temperature is to be controlled, and in that the first heat transfer fluid is expanded and/or cooled down and returned to the first heat exchanger after flowing through the second heat exchanger. Advantageous embodiments thereof include that the first heat transfer fluid is routed through a fourth heat exchanger after having flowed through the second heat exchanger and prior to flowing through the first heat exchanger again, which fourth heat exchanger is integrated into the second heat transfer fluid circuit and through which the second heat transfer fluid flows, before it is compressed by the compressor, and through which fourth heat exchanger the first heat transfer fluid is routed in a further section of the first heat transfer fluid circuit, namely, after passing through the first heat exchanger and prior to passing through the third heat exchanger, wherein it absorbs heat in this further section of the first heat transfer fluid circuit in this fourth heat exchanger from both the second heat transfer fluid and from the first heat transfer fluid recirculated in the section between the second heat exchanger and the first heat exchanger in the direction of the first heat exchanger. The first heat transfer fluid is expanded and/or cooled between exiting the fourth heat exchanger and before re-entering the first heat exchanger. For cooling the fluid whose temperature is to be controlled, the conveying direction of the conveying means and thus the flow direction of the first heat transfer fluid is reversed, wherein simultaneously the second heat transfer fluid circuit is interrupted and/or disconnected, wherein the first heat transfer fluid is routed through the second heat exchanger to absorb heat there from the fluid whose temperature is to be controlled, then flows through the third heat exchanger, without performing a further heat exchange there, or is routed around this third heat exchanger, then flows through the first heat exchanger to transfer heat there to the ambient medium, and then is returned to the second heat exchanger for again absorbing heat from the fluid whose temperature is to be controlled, wherein the first heat transfer fluid passes through this circuit without phase transitions. The first heat transfer fluid is actively cooled in a section of the first heat transfer fluid downstream of the first heat exchanger and upstream of the second heat exchanger. A liquid is used as the first heat transfer fluid, which liquid is liquid at atmospheric pressure in any case in the temperature range from −50° C. to +60° C. A hydrofluorether is used as the first heat transfer fluid.

The device according to the invention for controlling the temperature of a fluid accordingly has the following components:

a. a first closed heat transfer fluid circuit, in which a first heat transfer fluid circulates, the first heat transfer fluid being selected to circulate without phase transitions in the first heat transfer fluid circuit;
b. a second closed heat transfer fluid circuit in which a second, gaseous heat transfer fluid circulates, wherein the second, gaseous heat transfer fluid is selected such that it flows through the second heat transfer fluid circuit without phase transitions;
c. a first heat exchanger, arranged in the first heat transfer fluid circuit, in which first heat exchanger the first heat transfer fluid can be brought into a heat exchange with an ambient medium;
d. a second heat exchanger, arranged in the first heat transfer fluid circuit, in which second heat exchanger the first heat transfer fluid can be brought into a heat exchange with the fluid, whose temperature is to be controlled;
e. a first conveying means arranged in the first heat transfer fluid circuit for moving the first heat transfer fluid in the first heat transfer fluid circuit;
f. a compressor arranged in the second closed heating circuit for compressing the second, gaseous heat transfer fluid;
g. a third heat exchanger, which is disposed downstream of the compressor and in contact with the second heat transfer fluid circuit as seen in the flow direction of the second heat transfer fluid and in which a heat exchange with the first heat transfer fluid in the first heat transfer fluid circuit occurs;
h. a means for cooling down and/or expanding the first heat transfer fluid in the first heat transfer fluid circuit.

A special feature of this device according to the invention is that it does not require an evaporator or condenser, but has simple heat exchangers instead. This feature is due to the fact that none of the heat transfer fluids used, neither the first heat transfer fluid nor the second heat transfer fluid, undergoes a phase transition in the process.

The first heat exchanger in which a heat exchange of the first heat transfer fluid with an ambient medium occurs, may permit the heat transfer from, for instance, outside air, geothermal power, a liquid or a gas to the first heat transfer fluid. Accordingly, this first heat exchanger can be operated in counter current flow and has two inputs and outputs, one each for the respective heat transfer fluid. The first heat exchanger, however, may also be a fin heat exchanger having a fan for vehicles with only one input and one output for a single heat transfer fluid routed in a pipeline system, e.g. to use a heat exchange between an ambient heat of the ambient air and the first heat transfer fluid for the heating and/or cooling of the interior of a vehicle.

In turn, the second heat exchanger may be one which serves to exchange heat between the first heat transfer fluid and an ambient air used for air conditioning purposes, but also one which exchanges heat between the first heat transfer fluid and another fluid routed in a pipeline system. Thus, in the latter case, the second heat exchanger can, in turn, be a counterflow heat exchanger having two inputs and two outputs for the two fluids routed in pipeline systems, or in the former case again a fin heat exchanger having a fan, e.g. for vehicles (having only one input and output each for the first heat transfer fluid) for the direct exchange of heat with air flowing into the vehicle interior.

In a second heat transfer fluid circuit there is a compressor, in particular a turbocompressor, preferably a microturbocompressor, which compresses and in that way heats the second heat transfer fluid, which flows through this circuit in gaseous form, accordingly. This compressor is operated when the device is used for heating or for warming the fluid, whose temperature is to be controlled. In particular, this compressor can then react to the outside temperature in a speed-controlled manner, producing a higher pressure ratio by setting a higher speed and thus achieving higher temperatures of the compressed second heat transfer fluid (the opposite effect for a reduction of the speed).

In the third heat exchanger, the heat generated by the compressor in the second heat transfer fluid is transferred to the first heat transfer fluid when the system is operated as a heater. In case the device is used for cooling purposes (cf. below), in the third heat exchanger, if it is not completely disconnected by corresponding valves, typically the first heat transfer fluid only passes through, without any heat transfer. Usually, the compressor will not run in this case.

The means for cooling and/or expanding the first heat transfer fluid in the first heat transfer fluid circuit, if the device is operated in the heating mode as a heat pump, ensures in a known manner a further cooling of the returning first heat transfer fluid, to enable it to absorb heat from the environment even at low ambient temperatures and then provide it for heating purposes. If the device is used for cooling, the means for cooling may be used to possibly achieve a further lowering of the temperature of the first heat transfer fluid for an improved cooling effect in the second heat exchanger.

For this purpose, the means for cooling may advantageously be a, in particular controllable, Peltier element or a plurality of such Peltier elements. Such an element can cause a cooling effect independently of a pressure release, which is particularly advantageous for the operation of the device according to the invention for cooling, i.e. as an air conditioner or chiller.

In particular, a liquid can be used as the first heat transfer fluid, in particular one which is liquid at standard pressure, at least in the temperature range from −50° C. to +60° C. As the device according to the invention operates without phase transitions of the first heat transfer fluid, it has to be ensured that this fluid maintains a uniform phase in the range of the pertaining operating temperatures. A liquid first heat transfer fluid is preferable to a gaseous one, as its heat storage capacity is significantly higher. Of course, liquids having an even greater temperature range, within which they remain liquid, can also be used as the first heat transfer fluid. This temperature range can, for instance, be from −60° C. to +70°

C., even beyond, for instance, from −90° C. (or even lower, for instance down to −135° C.) to +75° C. or even +125° C.

In selecting the first heat transfer fluid, in addition to the temperature range within which it definitely retains its phase, the ability to absorb and store heat, e.g. ambient heat, in particular at low temperatures, even at temperatures below freezing, even in the lower negative range (heat capacity) as well as the ability to absorb and give off heat quickly have to be taken into account. A hydrofluoroether used as the first heat transfer fluid has proved to be suitable in this regard. Hydrofluoroethers are chemical compounds having the molecular formula $C_xF_y$—O—$C_mH_n$, where x is a number from 1 to 12; y is a number from 0 to 25; m is a number from 1 to 12 and n is a number from 0 to 25. The corresponding compounds are formed from chains of different lengths of fully fluorinated carbons, which are connected to an alkyl radical via an ether group. An example of a particularly suitable hydrofluoroether, which can be used as the first heat transfer fluid, is ethoxynonafluorobutane ($C_4F_9OC_2H_5$). This is a clear, colorless liquid having a setting point (at atmospheric pressure) of −138° C. and a boiling point (at atmospheric pressure) of 76° C. This material can be obtained, for instance, from 3M Deutschland GmbH under the trade name 3M™ Novec™ 7200 High-Tech Flü ssigkeit in a quality, which is well usable for use as the first heat transfer fluid in the device according to the invention.

The group of substances claimed here is not harmful to the climate, i.e. their use is not only highly efficient from a technological point of view, but also harmless from an ecological point of view.

The second, gaseous heat transfer fluid can in principle assume very different forms, with air being considered to be very suitable in this case. Using air as a second heat transfer fluid provides for sufficient temperature control effects, this fluid is available everywhere for "free", i.e. the use of air for this purpose does not result in any additional costs in production and operation. In addition, there are no possible environmental problems, which could possibly occur if another fluid is used, in particular if it escapes from a closed circuit.

Advantageously, a fourth heat exchanger can be provided in the device, which heat exchanger is integrated in the second heat transfer fluid circuit and is arranged upstream of the compressor and which is in heat exchange connection with the first heat transfer fluid routed in the first heat transfer fluid circuit.

In this heat exchanger, a first heat transfer between the second heat transfer fluid and the first heat transfer fluid is already achieved before the second heat transfer fluid is heated due to compression. In that regard, this additional heat exchanger contributes to an increase in efficiency of the heating mode of the device. If the device is to be used for cooling, this fourth heat exchanger has no function, and can also be bypassed using valves and pipeline sections.

Advantageously, this fourth heat exchanger may comprise three separate pipeline sections, mutually heat exchanging, of which a first pipeline section belongs to the second heat transfer fluid circuit, a second pipeline section belongs to a first section of the first heat transfer fluid circuit and a third pipeline section belongs to a second section of the first heat transfer fluid circuit. In this embodiment, therefore, the fourth heat exchanger has three inputs and outputs each and uses—in heating mode—additionally the waste heat from the return of the first heat transfer fluid for preheating the first heat transfer fluid after the first heat transfer fluid has absorbed ambient heat in the first heat exchanger and before it is further heated in the third heat exchanger by the heat of compression generated downstream of the compressor in the second heat transfer fluid circuit. The fourth heat exchanger also serves to cool the second heat transfer fluid in the second heat transfer fluid circuit.

In particular, if a further reduction of the pressure in the first heat transfer fluid circuit is required, which also contributes to a further cooling of the first heat transfer fluid in the return route to the first heat exchanger, an expansion valve, in particular an adjustable expansion valve, can be arranged in the second section of the first heat transfer fluid circuit.

The first conveying means for moving the first heat transfer fluid may in particular be a recirculation pump, which may in particular be designed to be controllable.

The first conveying means, for instance a recirculation pump, can be designed to be reversible, in particular in its conveying direction, so as to be able to convey or move or drive the first heat transfer fluid in two directions, a clockwise rotation, and counterclockwise rotation, through the closed first heat transfer fluid circuit. This circumstance of alternatively selecting an optional clockwise rotation or counterclockwise rotation is particularly important for the option of an optional operation of the device as a heating device (heat pump) or as a cooling device (air conditioning, chiller).

The method according to the invention for controlling the temperature of a fluid is accordingly characterized in that a first heat transfer fluid is routed in a first closed heat transfer fluid circuit and is circulated therein by a first conveying means to absorb and give off heat, the first heat transfer fluid in the first heat transfer fluid circuit being passed through a first heat exchanger for exchanging heat with an ambient medium. Further, the first heat transfer fluid is passed through a second heat exchanger for exchanging heat with the fluid, whose temperature is to be controlled, wherein the first heat transfer fluid is routed in the first heat transfer fluid circuit without undergoing phase transitions in the first heat transfer fluid circuit. For heating the fluid, whose temperature is to be controlled, the first heat transfer fluid is routed by the conveying means through the first heat exchanger to absorb heat there. After flowing through the first heat exchanger, the first heat transfer fluid is routed through a third heat exchanger, which is integrated in a second closed heat transfer fluid circuit, in which a second, gaseous heat transfer fluid without phase transitions is circulated. A compressor is arranged in the second heat transfer fluid circuit, which is arranged upstream of the third heat exchanger seen in the flowing direction of the second heat transfer fluid and which compresses and heats the second heat transfer fluid. Then the first heat transfer fluid absorbs heat from the second heat transfer fluid in the third heat exchanger and is routed through the second heat exchanger after having been routed through the third heat exchanger. There, the first heat transfer fluid gives off heat to the fluid, whose temperature is to be controlled. Finally, after flowing through the second heat exchanger, the first heat transfer fluid is expanded and/or cooled down and returned to the first heat exchanger.

This method may, and preferably will, be carried out in a device as described and explained above. In the procedure described above, the device operates as a heat pump, that is, a method for heating an active fluid is performed.

Advantageously, the first heat transfer fluid after passing through the second heat exchanger and before re-passing the first heat exchanger can be routed through a fourth heat exchanger, which is integrated into the second heat transfer fluid circuit and through which the second heat transfer fluid flows, before it is compressed by the compressor. Moreover, the first heat transfer fluid is routed through this fourth heat exchanger, in a further section of the first heat transfer fluid circuit, namely after flowing through the first heat exchanger and before flowing through the third heat exchanger. In this case, in this further section of the first heat transfer fluid circuit in this fourth heat exchanger, heat is absorbed both by the second heat transfer fluid (before compression) and by the first heat transfer fluid returned in the section between the second heat exchanger and the first heat exchanger in the direction of the first heat exchanger. This design of the method according to the invention increases the efficiency of the method or of the device operated in this way, if it is used as a heat pump, as in this case the residual heat otherwise uselessly dissipated is supplied to the effective circuit.

In the particular embodiment described above, moreover, the first heat transfer fluid can be expanded and/or cooled between leaving the fourth heat exchanger and before re-feeding it to the first heat exchanger. This can be done, for instance, by means of Peltier elements, but also, for instance, by using an expansion valve in the or in contact with the corresponding pipeline.

However, the method according to the invention can also optionally not be used for heating, i.e. for operating the device in the manner of a heat pump, but can also be used for cooling the fluid, whose temperature is to be controlled. In doing so, the conveying direction of the conveying means and thus the flow direction of the first heat transfer fluid is reversed, wherein simultaneously the second heat transfer fluid circuit is interrupted and/or decoupled to such a degree, that no heat transfer occurs between the second heat transfer fluid and the first heat transfer fluid. Then, the first heat transfer fluid is routed through the second heat exchanger, to absorb heat from the fluid whose temperature is to be controlled there and thus to cool this fluid whose temperature is to be controlled. Subsequently, the first heat transfer fluid then flows through the third heat exchanger, without performing another heat exchange there, or bypasses it, and then flows through the first heat exchanger, to give off heat to the ambient medium there. Subsequently, the first heat transfer fluid is returned to the second heat exchanger for reabsorption of heat from the fluid whose temperature is to be controlled. Again, the first heat transfer fluid passes through this cycle without phase transitions.

In this variant of the method, a special feature of the method according to the invention can be seen, which is also reflected as a special feature of the device according to the invention or a usage thereof. For here, one and the same device can be used both as a heat pump for heating purposes and for cooling a fluid, for instance as an air conditioner or chiller, based on the described reversal of the conveying direction of the first heat transfer fluid.

This design is of great interest in the automotive industry, amongst others, where such a device can be used for both heating and air-conditioned cooling the passenger compartment of an automobile. In particular, where, for instance, heat energy is no longer available in sufficient quantity to heat the passenger compartment due to the use of high-efficiency internal combustion engines, or also in the case of electric vehicles, whose type of drive does not generate any significant amount of heat energy to be used, alternative heating options have to be provided for the operation of the vehicle at cold ambient temperatures for which the device according to the invention and the method according to the invention are particularly suitable because they also offer a cooling option in addition to a heating option by simply reversing and rearranging the circuit of the first heat transfer fluid. However, this application is also of great advantage for instance in the field of air conditioning (heating/cooling) of passenger compartments in railway carriages and also in other means of transport, buildings and rooms, RVs and mobile homes or in equal measure in machinery and equipment.

If the method is used for cooling as described above, it may be required—depending on weather conditions and outside temperature and depending on the desired temperature setting for the area to be cooled—to intervene based on an active cooling of the first heat transfer fluid, wherein the first heat transfer fluid in a section of the first heat transfer fluid circuit downstream of the first heat exchanger and upstream of the second heat exchanger can be actively cooled, for instance by means of a Peltier element or by using several such elements. In the Peltier elements used, which are operated using electrical energy, besides the cold side used for cooling, a warm side of the element results, where heat has to be dissipated to be able to continue operating the Peltier element with cooling effect. This heat can be dissipated with advantage to an ambient heat transfer fluid and in this way added to the ambient heat. For this purpose, air can be used to cool the warm side of the Peltier element for instance using a fan or simply a passageway (e.g. charged by the airstream of a vehicle equipped with the device of the invention). However, it is also possible to form an additional circuit based on a heat transfer fluid, which absorbs the waste heat of the Peltier elements and in turn passes it on to an ambient medium, for instance via a heat exchanger. Such an ambient medium can also pass directly through the circuit (e.g. air but also a geothermal heat transfer fluid).

Within the scope of the method, the first heat transfer fluid is preferably one as has already been described above for the device, i.e. reference can be made to the above description with regard to the preferred selection of this first heat transfer fluid.

The device according to the invention and the method according to the invention can be used and applied in numerous ways, e.g. for heating or cooling buildings, in particular for residential and commercial buildings, as heating and air conditioning systems for the automotive industry, for the transport and logistics industry, for buses and trains, for engineering projects, but also for use in household appliances.

BRIEF DESCRIPTION OF DRAWINGS

Further advantages and features of the invention will become apparent from the following description of an exemplary embodiment based on the attached figures. In the figures.

LIST OF THE REFERENCE NUMERALS

Figure 1:
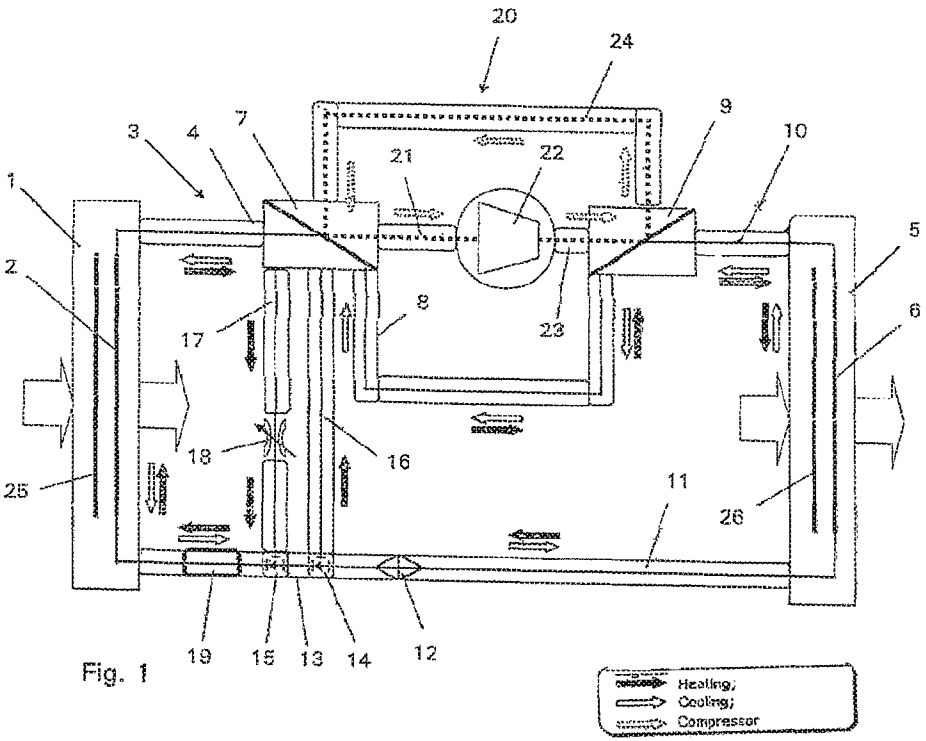
FIG. 1 shows a schematic representation of a device for controlling the temperature of a fluid in a first possible embodiment of the invention, including an illustration of the procedure.

1, 1' heat exchanger
2 pipeline

3 first circuit
4 pipe section
5, 5' heat exchanger
6 pipeline
7 heat exchanger
8 pipe section
9 heat exchanger
10 pipe section
11 pipe section
12 recirculation pump
13 pipe section
14 three-way valve
15 three-way valve
16 inlet
17 outlet
18 expansion valve
19 Peltier element
20 second circuit
21 pipe section
22 turbocompressor
23 pipe section
24 return pipeline
25 ventilator
26 fan
27 pipeline
28 pipeline section
29 fan
30 supply pipeline three-way valve
31 recirculation pump
32 three-way valve
33 three-way valve
34 bypass pipeline
35 three-way valve
36 three-way valve
37 return pipeline three-way valve

Way(s) for Implementing the Invention

In the figures, possible implementations of a device according to the invention for controlling the temperature of a fluid are outlined in principle in two embodiments slightly modified in relation to each other. In addition, a further modification is outlined in FIG. 3, which modification can be selected for both basic embodiments shown in the preceding figures. The figures also contain representations, which illustrate the procedure of a method according to the invention to be performed using these devices.

FIG. 1 shows, first of all, a first heat exchanger 1, which in this embodiment variant is a heat exchanger for providing a heat transfer between a gaseous ambient medium and a circulating heat transfer fluid routed in a pipeline 2. The first heat transfer fluid is routed in a first circuit 3. The pipeline 2 in the heat exchanger 1 is connected to a pipe section 4, which is part of a supply pipeline to a second heat exchanger 5, through which, in turn, the first heat transfer fluid flows in a pipeline 6 and which serves for exchanging heat between this first heat transfer fluid and a gaseous fluid.

In the supply pipeline, starting from the first heat exchanger 1 behind the pipe section 4, a further heat exchanger 7 is arranged, through which the heat transfer fluid supplied in the pipe section 4 flows and which leaves the heat transfer fluid via a further pipe section 8.

The flow can also pass through the heat exchanger 7 in the reverse direction, as will be explained later. The pipe section 8 is then connected to another heat exchanger 9, through which the heat transfer fluid flows to a subsequent pipe section 10, which then opens into the second heat exchanger 5, which pipe section 10 is connected to the pipeline 6 in this heat exchanger 5. Another pipe section 11 is connected to the heat exchanger 5, more precisely to the pipeline 6, on an opposite side and leads to a recirculating pump 12. Two switchable 3-way valves 14, 15 are arranged in a pipe section 13 downstream of the recirculation pump 12. In separate switching positions these permit either a routing of the flow of the first heat transfer fluid via a supply pipeline 16 through the heat exchanger 7 and back via an outlet 17, in which a controllable expansion valve 18 is provided, to the pipe section 13 or bypassing this loop through the heat exchanger 7 directly further in the pipe section 13. Viewed from the recirculation pump 12 at least one controllable Peltier element 19 is arranged beyond the 3-way valves 14, 15, several such elements may also be provided. The pipe section 13 then opens again into the pipeline 2 of the heat exchanger 1 and in that way closes the circuit 3.

In the device illustrated in FIG. 1, another circuit 20 is implemented, in which a second heat transfer fluid circulates. Here, the second heat transfer fluid flows through the heat exchanger 7, then passes into a pipe section 21 and is compressed by a turbocompressor (in particular a micro-turbocompressor) 22, routed through a piece of pipe 23 to the heat exchanger 9 and then via a return pipeline 24 back to the heat exchanger 7.

The device shown in FIG. 1 can now be operated in two modes, namely in one way as a heat pump to heat an active fluid routed through the heat exchanger 5, and in another way as an air conditioning device (air conditioning) to cool down an active fluid routed through the heat exchanger 5.

Below, first the use as a heat pump is described, in which the recirculating pump 12 makes the first heat transfer fluid in the circuit 3 circulate in a clockwise direction in the illustration of FIG. 1.

The direction of operation of the heat transfer fluids in the heat transfer fluid circuits 3 and 20 is illustrated for the first circuit 3 by the filled arrows and by the broken pipeline arrows for the second circuit 20.

In this mode of operation, ambient heat (e.g., from outside or exhaust air) is transmitted to the first heat transfer fluid in the first heat exchanger 1 as it passes pipeline 2. The first heat exchanger 1 may in particular be a fin heat exchanger with fan 25.

The first heat transfer fluid is transported by the recirculating pump 12 in clockwise direction in the closed heat transfer fluid circuit 3 and delivers the absorbed ambient heat to the heat exchanger 7.

In the heat exchanger 7, the temperature level of the first heat transfer fluid is raised by the waste heat, which originates from the return from the heat exchanger 5, and by cooling the second heat transfer fluid in the second circuit 20. In practice, the temperature level can be raised to approx. 30° C. if the temperature of the second heat transfer fluid in the return is cooled down to approx. 30°. The 3-way valves 14, 15 are accordingly in each case in a switching position, in which the inlet 16 and the outlet 17 are integrated into the circuit 3.

The speed-controlled turbocompressor 22, which may in particular be a micro-turbocompressor, takes in, compresses and raises the second heat transfer fluid (e.g., cooled to about 30° C.) to a high temperature level in the closed second circuit 20 in a diabatic process, the so-called heat of compression is impressed.

The second heat transfer fluid heated in this manner encounters the first heat transfer fluid again in the heat exchanger 9, which first heat transfer fluid is routed around the turbocompressor in the pipe section 8, and heats the first heat transfer fluid to a usable temperature.

The heated first heat transfer fluid flows to the heat exchanger 5, which in this exemplary embodiment can be a fin heat exchanger having a fan 26. In this heat exchanger 5, the first heat transfer fluid transfers this heat to an active fluid, e.g. aspirated fresh air.

The first heat transfer fluid comes from the heat exchanger 5 and flows through the 3-way valve 14 to the heat exchanger 7 for using the waste heat; the temperature of the return can, upon exiting the heat exchanger 7, be e.g. approx. 10° C.

The first heat transfer fluid cooled down to approx. 10° C. reaches the controllable Peltier elements 19 through the 3-way valve 15. On the way there, the controllable expansion valve 18 can expand and cool down the first heat transfer fluid. At the Peltier elements 19, the Peltier effect lowers the temperature of the heat transfer fluid to about 10K below the ambient heat. The heat produced on the other side of the Peltier element during the cooling can also advantageously be used to preheat the ambient heat. In this way, the energy consumed in the Peltier elements 19 is utilized in the best possible way. The Peltier elements 19 are controllable and the desired temperature range can be set.

After having been cooled by the controllable Peltier elements 19, the first heat transfer fluid returns to the heat exchanger 1. The cycle can start anew. It is important to mention that throughout the cycle, the first heat transfer fluid does not undergo any phase transitions. Rather, the first heat transfer fluid is a liquid, which remains liquid under all conditions occurring in the course of the first circuit 3. The first heat transfer fluid is in particular a hydrofluoroether, e.g. ethoxynonafluorobutane ($C_4F_9OC_2H_5$).

The second heat transfer fluid also does not undergo a phase change, but remains gaseous throughout the entire passage of the second circuit 20.

As already mentioned, the device constructed according to the diagram shown in FIG. 1 can be operated not only as a heat pump, but also for cooling or air-conditioning an active fluid.

The device is operated as follows; this operation is represented by the unfilled arrows drawn with an unbroken contour line in the figure.

When operating the device as an air conditioner, the second circuit 20 is disabled; the turbocompressor 22 is not needed for cooling purposes and therefore remains out of service.

In such a mode of operation of the apparatus as an air conditioner, the ambient medium (e.g., outside or exhaust air) is preferably colder than the first heat transfer fluid in order to transfer heat from the first heat transfer fluid in the heat exchanger 1 to the ambient medium. However, the device also works when the ambient medium is warmer than the first heat transfer fluid when it flows through the heat exchanger 1 in the pipeline 2.

After the heat transfer fluid has absorbed ambient heat or released heat to the ambient medium, it flows through the controllable Peltier elements 19 for a possibly required further cooling. This is effected by the recirculation pump 12, which makes the first heat transfer fluid now flow through the first circuit 3 in the opposite direction. For this purpose, the direction of flow of the recirculation pump 12 is designed to be reversible. In the illustration of the figure, the recirculating pump 12 moves the first heat transfer fluid in the counterclockwise direction in the circuit 3.

A controller preferably controls the energy consumption of the Peltier elements 19 such that a difference between the temperature of the ambient medium and the temperature of the first heat transfer fluid is e.g. approx. 10 K.

After the temperature reduction, the first heat transfer fluid flows through the two 3-way valves 14, 15, which are set such that the heat transfer fluid is directly passed into the pipe section 11 without reaching the heat exchanger 7. I.e. the first heat transfer fluid reaches the heat exchanger 5 directly.

In this heat exchanger 5, the heat transfer fluid absorbs heat from the working fluid and cools it down. In the device according to FIG. 1, this working fluid can be in particular fresh air that has been aspirated and cooled, which is then returned to spaces to be air-conditioned, e.g. the passenger compartment of a vehicle.

The first heat transfer fluid emerges at a higher temperature from the heat exchanger 5 than it had when it has entered this heat exchanger 5, and flows to the heat exchanger 9. The first heat transfer fluid flows through this heat exchanger 9 and on to the heat exchanger 7 without any further heat exchange. For this purpose, the first heat transfer fluid is bypassed around the turbocompressor 22 in the pipe section 8.

Now the first heat transfer fluid again flows through the heat exchanger 1 and there, if it is at a higher temperature level than the ambient temperature, gives off heat, then the cycle starts anew.

It is also possible to provide a further pipeline route, which can be toggled in particular using valves, in which the first heat transfer fluid passes directly from the heat exchanger 5 to the heat exchanger 1, thereby bypassing the heat exchangers 7 and 9, which in this mode make no functional contributions to the cooling process anyway.

Figure 2:
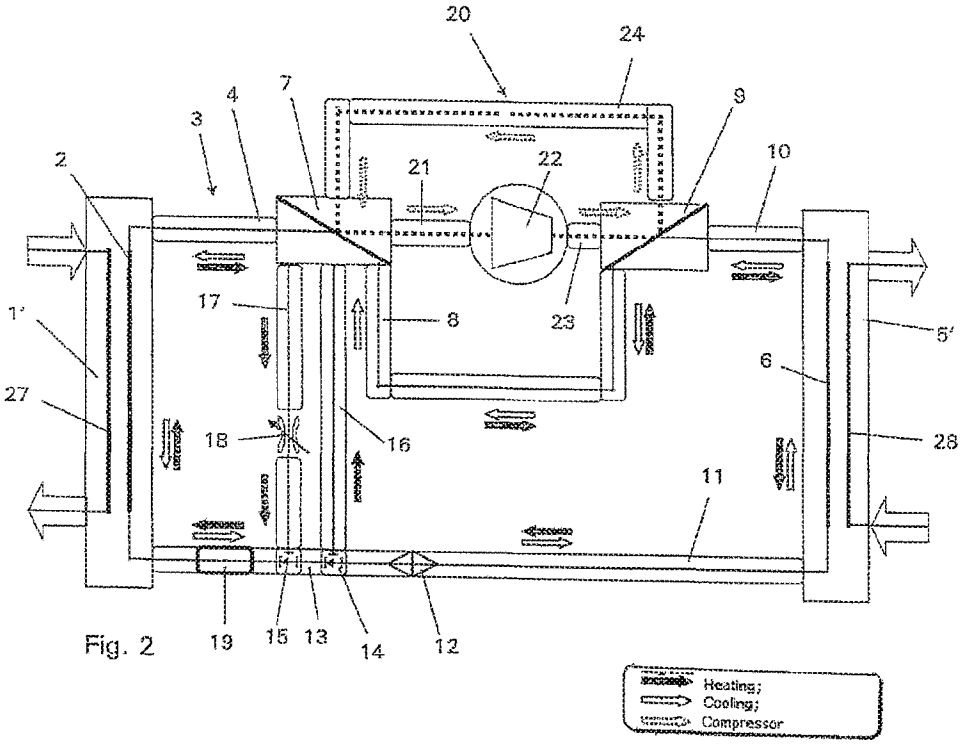
FIG. 2 shows a schematic representation of a device for controlling the temperature of a fluid in a second possible embodiment of the invention, including an illustration of the procedure.

FIG. 2 shows a sketch of a device constructed along the same general principle, which operates according to the same principle, such that reference can be made in this respect to the above description. The only difference between the illustration in FIG. 2 and that in FIG. 1 is that the heat exchangers 1 and 5 shown in FIG. 1 have been replaced by heat exchangers 1' and 5' in the design according to FIG. 2, wherein the heat exchangers 1' and 5' are now also connected to a pipeline system at the entry and exit sides and are not freely traversed by air as is the case with fins. Of course, in any case, a gaseous fluid, e.g. air, may also pass through one of the pipeline systems in this heat exchanger, in particular the pipeline 27 and/or the pipeline section 28. In such an embodiment, the device is suitable for instance for heating living spaces, for instance, by supplying a fluid for transporting geothermal heat to the heat exchanger 1' in a pipeline 27 and by using the heat exchanger 5' for heating a heat transfer fluid, for instance water, in a pipeline section 28 of a heating circuit. In reverse operation as described above, living spaces can be cooled (air-conditioned) as well.

Figure 3:
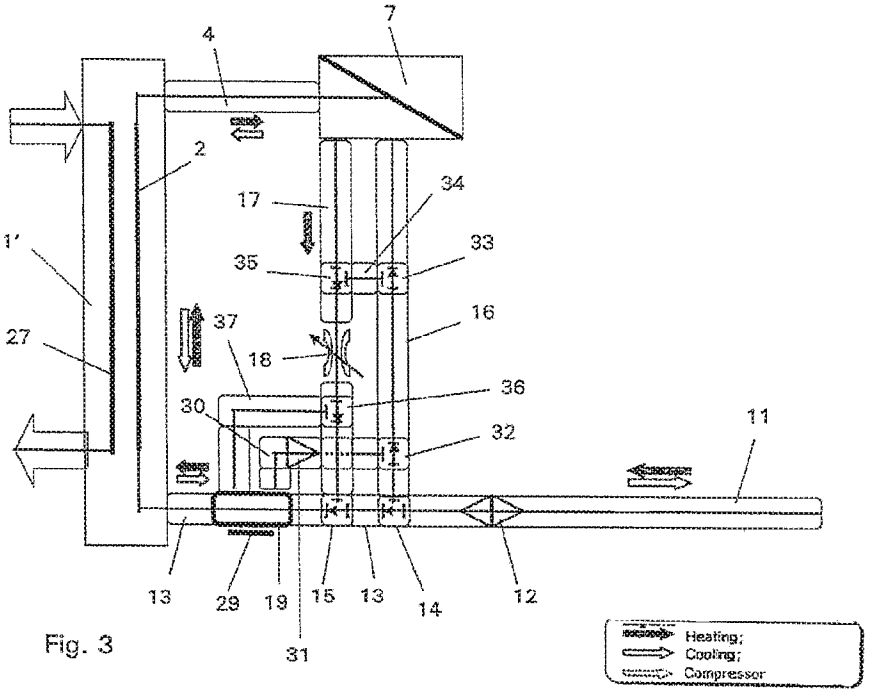
FIG. 3 shows a schematic representation of a section of the device according to the illustration in FIG. 2, including the illustration of an active cooling of the Peltier elements.

Finally, FIG. 3 shows a variant by depicting a detail or a partial section of the illustration according to FIG. 2 in which—if the device is used for air conditioning (cooling) - the Peltier elements 19 are actively cooled on their heat-emitting side. Such an active cooling may be required in particular if the ambient temperature is particularly high. If the device is used, for instance, in the context of a vehicle, the airstream may suffice to dissipate the heat released by the Peltier elements in each case at their heat-dissipating part. This may be more difficult for stationary systems.

For this purpose, a fan 29 may initially be provided. If the provision of such a fan 29 is sufficient to adequately cool the Peltier element(s) on their heat-emitting sides, no further cooling measures are required. If the supply of fresh air by means of the fan 29 alone does not suffice, then additionally or alternatively a further cooling mechanism may be provided, e.g. such as outlined in FIG. 3.

Cooling by means of a heat transfer fluid is provided there, the first heat transfer fluid from the heat transfer fluid circuit 3 being used in this embodiment.

Heat transfer fluid flowing in a supply pipeline 30 absorbs waste heat from the Peltier element(s) 19. A recirculation pump 31 then conveys the heat transfer fluid in the direction of a 3-way valve 32. The 3-way valve 32 can be connected to the inlet 16. If, in the cooling mode of the device, the 3-way valve 32 is connected to the inlet 16, this inlet 16 is separated from the pipeline formed by the pipe sections 11 and 13 by means of the 3-way valve 14. As a result, the first heat transfer fluid, after flowing through the 3-way valve 32, is routed via the inlet 16 to a further 3-way valve 33. In this operating mode, the latter blocks the inlet 16 from the heat exchanger 7 and transfers the flow from the first heat transfer fluid to a bypass pipeline 34 instead. This is connected to a further 3-way valve 35, which is connected to the outlet 17. In this mode of operation, the 3-way valve 35 shuts the outlet 17 of the heat exchanger 7 and routes the first heat transfer fluid to the expansion valve 18. There, the first heat transfer fluid is expanded and thereby cooled down. A further 3-way valve 36 downstream of the expansion valve 18, which in this mode of operation closes the outlet 17 of the 3-way valve 15, is used to transfer the cooled and expanded heat transfer fluid to a return pipeline 37 connected to the 3-way valve 36 and from there again to the Peltier elements 19, where it again absorbs waste heat, and to then return to the supply pipeline 30. This cycle is activated by a controller switching the relevant 3-way valves 32, 33, 35 and 36 if the device is operating in the cooling mode and therefore an active cooling of the Peltier elements 19 is required.

Of course, as the person skilled in the art recognizes offhand, a corresponding pipeline and valve arrangement and circuit can also be implemented for the exemplary embodiment of a device according to the invention shown in FIG. 1.

It is also possible to operate an active cooling of the Peltier element (s) 19 as described above, in heat pump mode as well, for instance if the first heat transfer fluid has to be cooled down particularly far in order to be able to absorb ambient heat at a low temperature level in the heat exchanger 1 or 1', respectively. In such a case, then the short-circuit pipeline 34 is typically not used, the 3-way valves 33 and 35 may be connected such that the heat exchanger 7 remains integrated in the circuit. In addition, in such a circuit, the 3-way valves 14 and 15 are connected such that they integrate the inlet 16 and the outlet 17. The 3-way valves 32 and 36 are then switched such that they open both a connection to the 3-way valves 14 and 15 and the connection in the direction of the recirculation pump 31 and the return pipeline 37. The 3-way valve 32 also has to have a check valve, to prevent the first heat transfer fluid, pressurized by means of the recirculation pump 12, from flowing into the 3-way valve 32 in the direction opposite to the intended direction from the inlet 16 from the 3-way valve 14.

In this case the flow directions and flow patterns of the first cooling fluid for the first cooling fluid circuit 3 if operated as a heater (heat pump) or as a chiller (for air conditioning) are indicated in FIG. 3 using arrows, as can be seen in the legend arranged in the figure.

A special feature of the invention is the selection of the first heat transfer fluid. As already mentioned, this is preferably a hydrofluoroether (a chemical compound having the molecular formula $C_xF_y$—O—$C_mH_n$, where x is a number from 1 to 12; y is a number from 0 to 25; m is a number from 1 to 12 and n is a number from 0 to 25). Such compounds are liquid at normal temperature and pressure. Their setting point is typically in the temperature range from −38° C. to −138° C., and the boiling point is between 34° C. and 128° C. These compounds are liquid between setting point and boiling point. The densities of these liquids are significantly higher than those of heat transfer fluids used in known and pertinent devices. This fluid is also electrically nonconductive, i.e. it can be used as a cooling fluid for cooling the Peltier elements 19, to which a voltage has been applied, in the manner described above, without leading to a short circuit or the like.

The global warming potential (GWP) of such compounds is also very significantly lower than the GWP of previously used heat transfer fluids, namely between 5 days and 4.9 years. Hydrofluoroethers are compatible with many metals, plastics and elastomers, permitting the use of smaller components of lower cost in the implementation of devices operated using these fluids.

Unlike the heat transfer fluids used hitherto, hydrofluoroethers are not dangerous goods and do not need to be specially treated in accordance with the legislation during transport, assembly, repair or service, disassembly or accidents. Rather, they are accordingly simpler and less risky to handle and use, and more environmentally friendly.

Hydrofluoroethers are also not electrically conductive, non-flammable and not combustible and can therefore also be used where there is a fire hazard in case of an accident, where short circuits in the electrical circuit would be possible or environmental hazards might develop.

A harmless gaseous heat transfer fluid, for instance air, may be used in the second heat transfer fluid circuit.

The turbocompressor in the second heat transfer fluid circuit can operate at a pressure of only up to 4 bar and yet already achieve sufficient heating of the second heat transfer fluid. The comparatively low pressure significantly reduces the risk of accidents, leaks, and environmental hazards.

Only a small volume of the second heat transfer fluid is required in the second heat transfer fluid circuit. Furthermore, the pressure there is low and a second heat transfer fluid is also preheated before entering the turbocompressor, i.e. the required electrical power in heat pump mode of the device is very low. A further reduction of the required electrical power can be achieved if the turbocompressor is equipped with a gas or a magnetic bearing.

Advantages of the turbocompressors, in particular the preferred micro-turbocompressors used, are, amongst others only very small mechanical losses and thus a very high efficiency rate. It is easy to control the power output of turbocompressors. They can be used to cover a wide output spectrum. In contrast to the usual scroll compressors in known devices, the turbocompressors are characterized in that there is no pressure pulsation. There is also no need for a lubricant, such as oil in the scroll compressors, with turbocompressors. They have—in particular as micro-turbocompressors—very small design sizes. A 5,000 W micro-turbocompressor, for instance, has the dimensions: length 25.4 cm, diameter 8.0 cm. For comparison purposes: A scroll compressor of the same output has the dimensions: length 60.0 cm and diameter 40.0 cm. As a result, the turbocompressors are also very light compared to the usual scroll compressors. Turbocompressors are virtually maintenance-free and therefore have extremely low operating costs. The lifetime of these compressors is many times higher than that of scroll compressors.

Micro-turbocompressors can have the disadvantage that the very high speeds of the impeller shaft (up to 500,000 rpm at peak load, normally between 80,000 rpm and 180,000 rpm) can cause noise, these are, however, manageable.

Due to the new process and use of modified parts and components, a significant increase in COP and JAZ is achieved.

The invention claimed is:

1. A device for controlling the temperature of a fluid, said device comprising:

a. a closed first heat transfer fluid circuit in which a first heat transfer fluid circulates, the first heat transfer fluid being selected to circulate without phase transitions in the first heat transfer fluid circuit;

b. a closed second heat transfer fluid circuit in which a second, gaseous heat transfer fluid circulates, wherein the second, gaseous heat transfer fluid is selected such that it flows through the second heat transfer fluid circuit without phase transitions;

c. a first heat exchanger arranged in the first heat transfer fluid circuit wherein the first heat transfer fluid is brought into heat exchange in the first heat exchanger with an ambient medium;

d. a second heat exchanger arranged in the first heat transfer fluid circuit, wherein the first heat transfer fluid is brought into heat exchange in the second heat exchanger with a fluid whose temperature is to be controlled;

e. a first conveying means arranged in the first heat transfer fluid circuit for moving the first heat transfer fluid in the first heat transfer fluid circuit;

f. a compressor arranged in the second heat transfer fluid circuit for compressing the second, gaseous heat transfer fluid;

g. a third heat exchanger that is disposed downstream of the compressor and in contact with the second heat transfer fluid circuit as seen in the flow direction of the second heat transfer fluid and wherein the third heat exchanger exchanges heat with the first heat transfer fluid in the first heat transfer fluid circuit;

h. a means for cooling down or expanding the first heat transfer fluid in the first heat transfer fluid circuit; and i. wherein the device further comprises a fourth heat exchanger provided in the device, wherein the fourth heat exchanger is integrated in the second heat transfer fluid circuit and is arranged upstream of the compressor, and wherein the fourth heat exchanger is in a heat exchange connection with the first heat transfer fluid routed in the first heat transfer fluid circuit.

2. The device according to claim 1, wherein a liquid is used as the first heat transfer fluid, and wherein the liquid is liquid at atmospheric pressure in a temperature range of from about −50° C. up to about +60° C.

3. The device according to claim 1, wherein the first heat transfer fluid is a hydrofluoroether.

4. The device according to claim 1, wherein the means for cooling down the first heat transfer fluid comprises at least one Peltier element.

5. The device according to claim 1, wherein the fourth heat exchanger comprises three separate pipeline strands that are mutually heat exchanging, wherein a first pipeline strand of the three separate pipeline strands belongs to the second heat transfer fluid circuit, a second pipeline strand of the three separate pipeline strands belongs to a first section of the first heat transfer fluid circuit; and a third pipeline strand of the three separate pipeline strands belongs to a second section of the first heat transfer fluid circuit.

6. The device according to claim 5, wherein the second section of the first heat transfer fluid circuit to which the third pipeline strand belongs, is incorporated into the first heat transfer fluid circuit or is-separated therefrom and is bypassed using valves.

7. The device according to claim 5, further comprising an expansion valve arranged in the second section.

8. The device according to claim 1, wherein the first conveying means is reversible with respect to a conveying direction.

9. The device according to claim 1, wherein the compressor is a turbocompressor.

10. A method for controlling the temperature of a fluid comprising:

routing a first heat transfer fluid in a closed first heat transfer fluid circuit;

circulating the first heat transfer fluid in the first heat transfer fluid circuit by a first conveying means to absorb or give off heat;

routing the first heat transfer fluid in the first heat transfer fluid circuit through a first heat exchanger to exchange heat with an ambient medium;

routing the first heat transfer fluid through a second heat exchanger to exchange heat with a fluid whose temperature is to be controlled;

wherein the first heat transfer fluid is routed in the first heat transfer fluid circuit without undergoing phase transitions in the first heat transfer fluid circuit;

wherein for heating the fluid whose temperature is to be controlled, the first heat transfer fluid is routed by the conveying means through the first heat exchanger in order to absorb heat there;

wherein the first heat transfer fluid is routed through a third heat exchanger after having flowed through the first heat exchanger, wherein the third heat exchanger is integrated in a closed second heat transfer fluid circuit in which a second, gaseous heat transfer fluid is circulated without phase transitions;

wherein a compressor is disposed upstream of the third heat exchanger in the second heat transfer fluid circuit as seen in the direction of flow of the second heat transfer fluid, and wherein the compressor compresses and heats the second heat transfer fluid;

wherein the first heat transfer fluid absorbs heat from the second heat transfer fluid in the third heat exchanger, in that the first heat transfer fluid is routed through the second heat exchanger after passing through the third heat exchanger;

wherein in the second heat exchanger, the first heat transfer fluid gives off heat to the fluid whose temperature is to be controlled and the first heat transfer fluid is expanded or is cooled down and is returned to the first heat exchanger after flowing through the second heat exchanger; and wherein the method further comprises:

routing the first heat transfer fluid through a fourth heat exchanger after the first heat transfer fluid has flowed through the second heat exchanger and prior to the first heat transfer fluid flowing through the first heat exchanger again;

integrating the fourth heat exchanger into the second heat transfer fluid circuit and through which the second heat transfer fluid flows before the second heat transfer fluid is compressed by the compressor;

routing the first heat transfer fluid through the fourth heat exchanger in a further section of the first heat transfer fluid circuit and after passing through the first heat exchanger and prior to passing through the third heat exchanger;

wherein the first heat transfer fluid absorbs heat in this further section of the first heat transfer fluid circuit in this fourth heat exchanger from both the second heat transfer fluid and from the first heat transfer fluid recirculated in a section between the second heat exchanger and the first heat exchanger in the direction of the first heat exchanger.

11. The method according to claim 10, further comprising expanding or cooling the first heat transfer fluid between the first heat exchanger fluid exits the fourth heat exchanger or before the first heat exchanger fluid re-enters the first heat exchanger.

12. The method according to claim 10, further comprising:

reversing a conveying direction of the conveying means for cooling the fluid whose temperature is to be controlled and thus reversing the flow direction of the first heat transfer fluid;

simultaneously interrupting or disconnecting the second heat transfer fluid circuit;

wherein the first heat transfer fluid is routed through the second heat exchanger to absorb heat from the fluid whose temperature is to be controlled, then flows through the third heat exchanger without performing a further heat exchange, or the first heat transfer fluid is routed around the third heat exchanger, then flows through the first heat exchanger to transfer heat to the ambient medium, and then is returned to the second heat exchanger for again absorbing heat from the fluid whose temperature is to be controlled; and wherein the first heat transfer fluid passes through this first heat transfer circuit without phase transitions.

13. The method according to claim 12, further comprising actively cooling the first heat transfer fluid in a section of the first heat transfer fluid circuit (downstream of the first heat exchanger and upstream of the second heat exchanger.

14. The method according to claim 10, further comprising:

using a liquid as the first heat transfer fluid, which liquid is liquid at atmospheric pressure and in a temperature range of from about −50° C. up to about +60° C.

15. The method according to claim 10, further comprising:

using a hydrofluorether as the first heat transfer fluid.

* * * * *